US006077195A

United States Patent [19]

Lane et al.

[11] Patent Number: 6,077,195

[45] **Date of Patent: *Jun. 20, 2000**

[54] BALANCE BEAM

[75] Inventors: Mark R. Lane, Jefferson; Neal C. Squibb, Scranton; Leslie M. Arp, Jefferson; Sue M. Sherlock, Jefferson; Martha Nichols-Ketchum, Jefferson, all of Iowa; Bill W. Sorenson, Westport, Conn.

[73] Assignee: American Sports International, Ltd., Jefferson, Iowa

[ * ] Notice: This patent is subject to a terminal disclaimer.

[21] Appl. No.: 09/135,710

[22] Filed: Aug. 18, 1998

Related U.S. Application Data

[63] Continuation-in-part of application No. 08/961,479, Oct. 31, 1997, Pat. No. 5,885,189.

[51] Int. Cl.[7] ..... A63B 4/00

[52] U.S. Cl. ..... 482/38; 482/34; 248/560

[58] Field of Search ..... 482/38, 39, 41, 482/34, 35, 36, 23, 15, 16, 17, 25; 108/117, 118, 116; 248/560, 592, 595, 562

[56] References Cited

U.S. PATENT DOCUMENTS

| | | | |
|---|---|---|---|
| 3,990,697 | 11/1976 | Reuther . | |
| 4,143,602 | 3/1979 | Brunn | 108/117 |
| 4,272,073 | 6/1981 | Grosser et al. | 482/34 |
| 5,037,086 | 8/1991 | Strand | 482/34 |
| 5,199,930 | 4/1993 | Weber | 482/17 |
| 5,885,189 | 3/1999 | Lane et al. | 482/38 |

FOREIGN PATENT DOCUMENTS

| | | | |
|---|---|---|---|
| 246362 | 6/1969 | U.S.S.R. | 482/41 |
| 1253652 | 8/1986 | U.S.S.R. | 482/41 |
| 737759 | 9/1955 | United Kingdom | 482/41 |

*Primary Examiner*—Richard J. Apley
*Assistant Examiner*—Justine R. Yu
*Attorney, Agent, or Firm*—Zarley, McKee, Thomte, Voorhees & Sease

[57] ABSTRACT

The balance beam of this invention has an elongated beam member having opposite ends, a center portion, a top and a bottom, with legs on the bottom thereof adjacent the ends. Each leg has an upper and a lower end. A resilient support and trolley assembly is mounted within the elongated beam adjacent the ends thereof with each support assembly having a depending arm member extending downwardly therefrom with each arm member being pivotally secured to one of the upper ends of the legs. The legs extend downwardly and outwardly from the arm member in the plane of the beam member so that the lower ends thereof dwell substantially under the ends of the beam member. Elongated links are pivotally secured by their ends to one end of the beam and one end of each of the legs to hold the beam member in an erected elevated horizontal position. The resilient support and trolley assembly is longitudinally movably positioned within the beam and has two end blocks rigidly secured to a trolley. An intermediate block is slidably mounted between the end blocks and is associated with the arm member. A resilient element is located between the intermediate block and the end block nearest the center portion of the beam member so that when a vertical force is applied downwardly on the top of the beam, the resilient element will yieldingly resist the sliding of the intermediate block towards the center portion. The resilient element moves on an inclined plane, and is associated with a pair of tension springs which connect the support assembly to the beam.

29 Claims, 7 Drawing Sheets

BALANCE BEAM

CROSS REFERENCE TO A RELATED APPLICATION

This application is a continuation-in-part of application Ser. No. 08/961,479 filed Oct. 31, 1997 now U.S. Pat. No. 5,885,189.

BACKGROUND OF THE INVENTION

The balance beam has long been a popular piece of gymnastics equipment. Efforts have been made to provide balance beams with some reflex action to absorb the impact of gymnasts performing thereon. However, such beams do not stay constant at any height adjustment, and get more flexible at lower heights.

Further, existing balance beams sometimes cause the legs of the beam to be extended so far that they require different floor mats for certain height adjustments of the legs. In addition, existing balance beams often are complex in assembly, and the heights thereof are not easily adjusted.

It is therefore a principal object of this invention to provide a balance beam that can be easily and quickly adjusted in height.

A further object of this invention is to provide a reflex action utilizing a urethane or metal spring wherein various durometer values can be used to create different degrees of balance.

These and other objects will be apparent to those skilled in the art.

SUMMARY OF THE INVENTION

The balance beam of this invention has an elongated beam member having opposite ends, a center portion, a top and a bottom, with legs on the bottom thereof adjacent the ends.

Each leg has an upper and a lower end. A resilient support and trolley assembly is mounted within the elongated beam adjacent the ends thereof with each support assembly having a depending arm member extending downwardly therefrom with each arm member being pivotally secured to one of the upper ends of the legs. The legs extend downwardly and outwardly from the arm member in the plane of the beam member so that the lower ends thereof dwell substantially under the ends of the beam member. Elongated links are pivotally secured by their ends to one end of the beam and one end of each of the legs to hold the beam member in an erected elevated horizontal position.

The resilient support and trolley assembly is longitudinally movably positioned within the beam and has two endblocks rigidly secured to a trolley. An intermediate block is slidably mounted between the endblocks and is associated with the arm member. A resilient element is located between the intermediate block and the endblock nearest the center portion of the beam member so that when a vertical force is applied downwardly on the top of the beam, the resilient element will yieldingly resist the sliding of the intermediate block towards the center portion. The resilient element moves on an inclined plane, and is associated with a pair of tension springs which connect the support assembly to the beam.

DESCRIPTION OF THE PREFERRED EMBODIMENT

Figure 1:
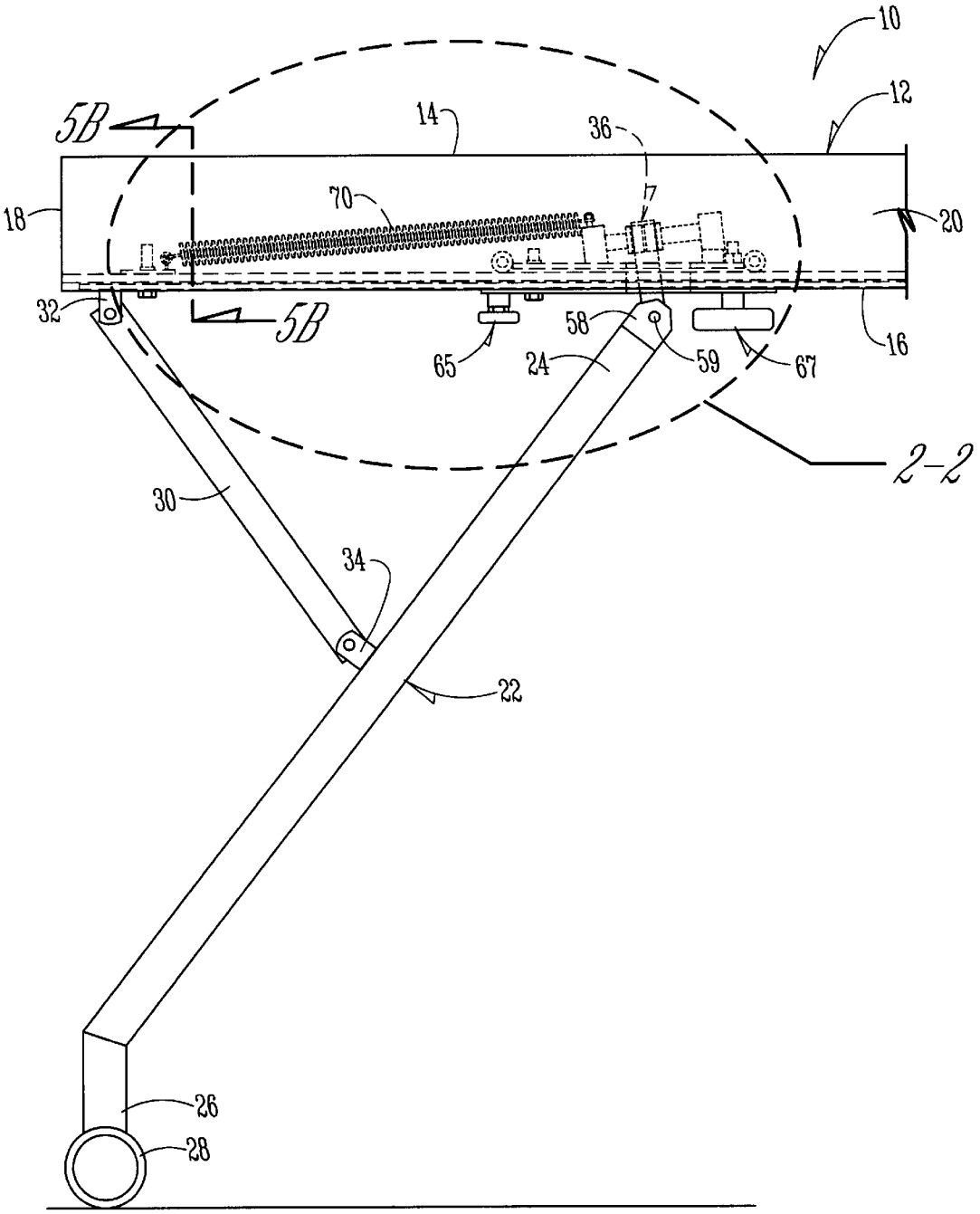
FIG. 1 is a side elevational view of one end of the balance beam of this invention.

As best shown in FIG. 1, the slightly resilient balance beam 10 is comprised of a hollow elongated metal beam member 12 which has a top 14, bottom 16, opposite ends 18, and a center portion 20.

A leg 22 is mounted to each of the opposite ends 18 of beam member 12. Each leg has an upper end 24, and a lower end 26. A transverse horizontal floor engaging portion 28 is located at the lower end 26 of each leg 22. Member 28 extends transversely to the longitudinal axis of beam member 12. A diagonally disposed link 30 is pivotally secured by its ends to tabs 32 and 34 which are secured to the lower bottom ends of beam member 12 and to the mid point of legs 22 (FIG. 1).

A trolley support assembly 36 is shown in dotted lines in FIG. 1 and is shown in more detail in FIGS. 3, 4, 7 and 8. The assembly 36 is mounted on base plate 38 which has a square or rectangular opening 40 therein.

Figure 4:
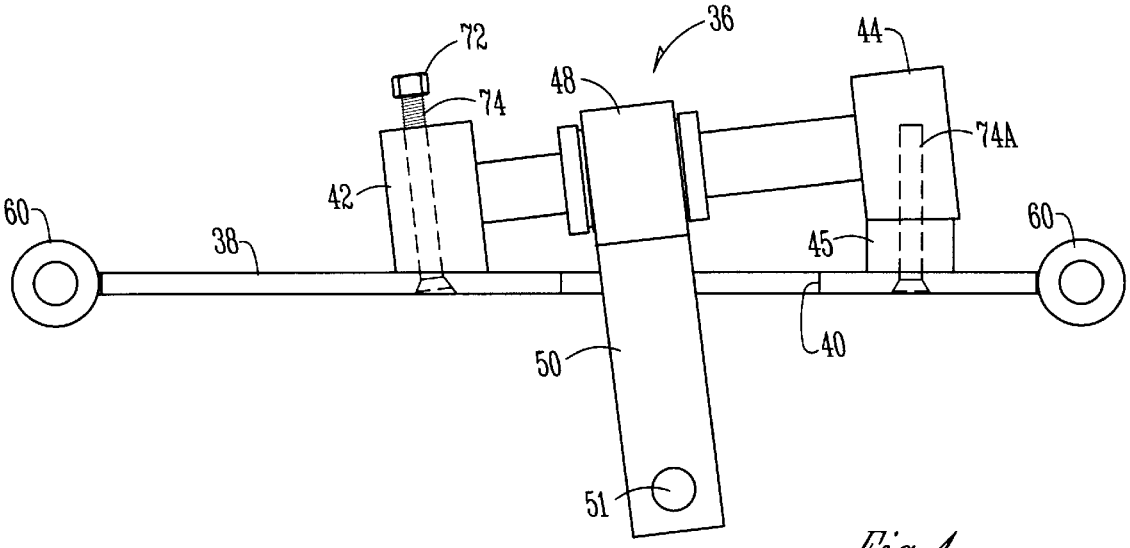
FIG. 4 is a reduced scale side elevational view of the trolley assembly.

A block 42 and a block 44 are rigidly secured to plate 38 in any convenient manner and are positioned in parallel spaced relationship to each other. Block 44 is elevated with respect to block 42 by block 45 (FIG. 4). Two ¾ inch diameter ground and polished steel shafts 46 extend in parallel spaced relationship with respect to the blocks 42 and 44. An intermediate block 48 is slidably mounted on shafts 46 and has an arm 50 with aperture 51 therein which extends downwardly through opening 40. Linear bearings 52 surround shafts 46 and are mounted in suitable apertures in intermediate block 48 to facilitate the sliding action of the intermediate block 48 with respect to the shafts 46.

An elongated small diameter rod 54 has its ends mounted in blocks 42 and 44 and extends through an aperture 55 in intermediate block 48. A resilient element 56 is mounted on rod 54 between intermediate block 48 and block 44 which is nearest the center portion 20 of the beam member 12. The resilient element 56 is a urethane spring. Its resiliency is determined by its durometer value which preferably is in the range of 60–95 Shore A. Various springs 56 can be utilized to accommodate athletes of different weights. The center axes of members 46, 54 and 56 are inclined downwardly towards end 18 by block 45.

A clevis 58 is rigidly secured to the upper end 24 of each leg 22 and is pivotally secured thereto by pin 59. (FIG. 1).

Figure 7:
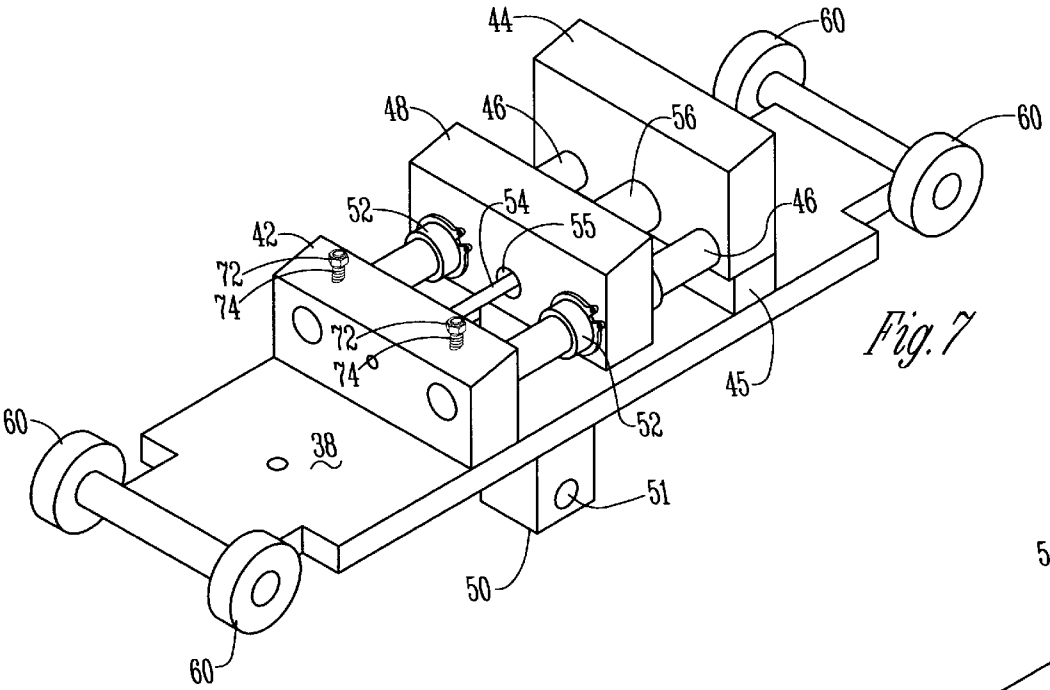
FIG. 7 is an enlarged scale top perspective view of the trolley assembly.
Figure 8:
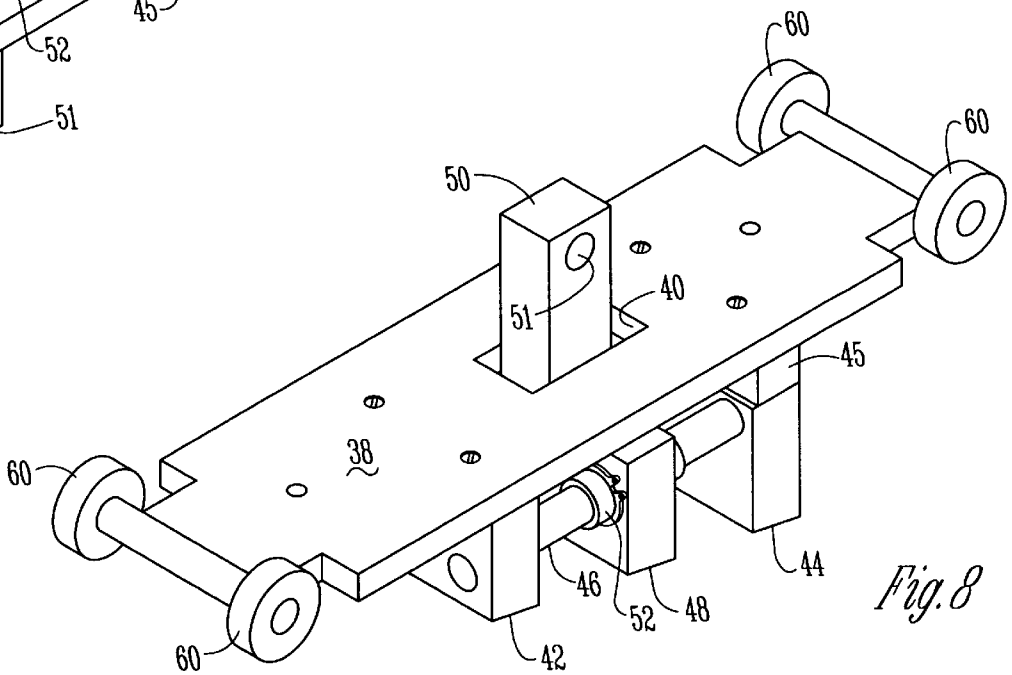
FIG. 8 is an enlarged scale bottom perspective view of the trolley assembly.

Trolley wheels 60 are rotatably mounted at the ends of plate 38 in any convenient fashion. (FIGS. 7 and 8).

Figure 2:
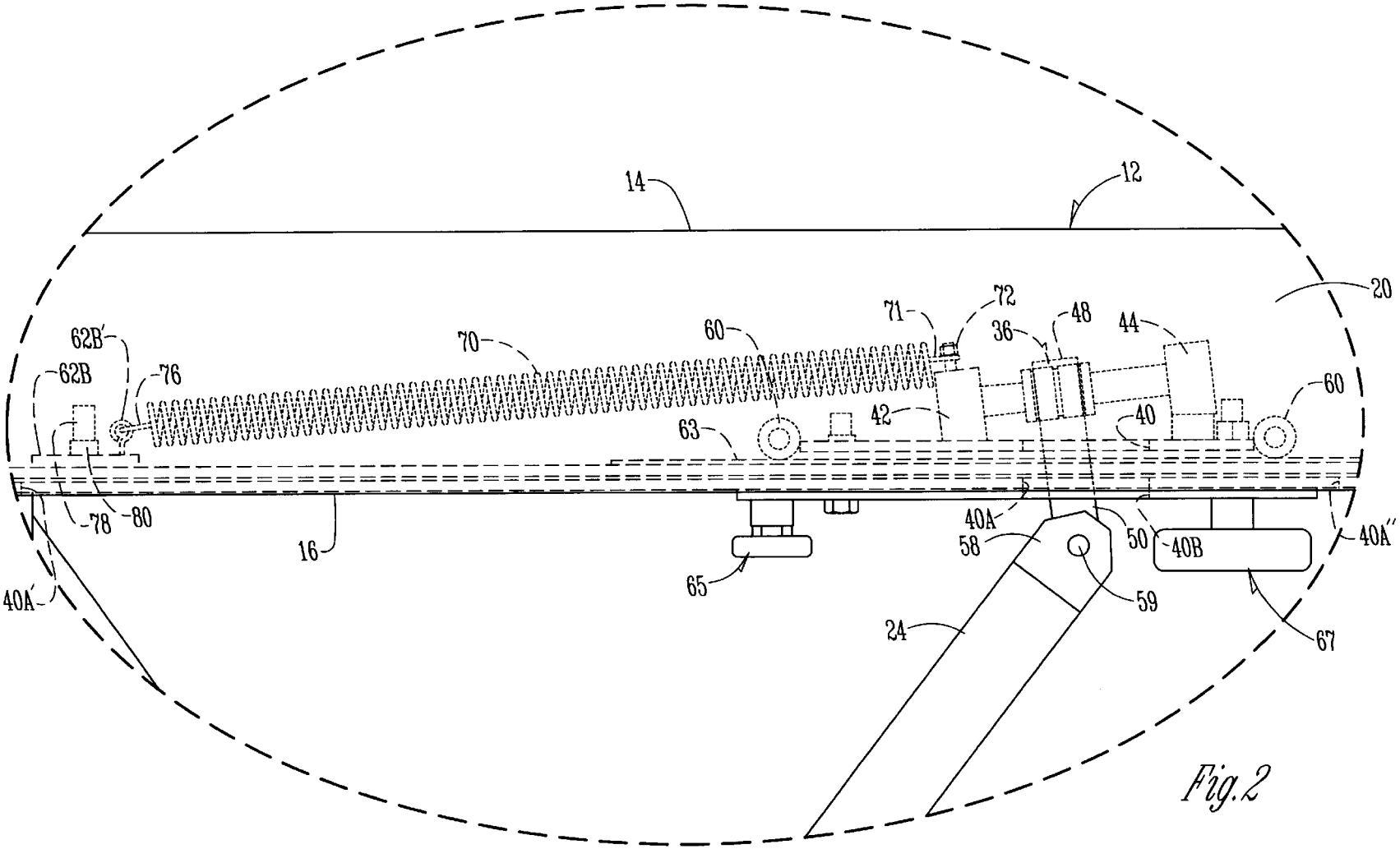
FIG. 2 is an enlarged scale side elevational view of the support assembly taken within the dotted lines of FIG. 1.
Figure 3:
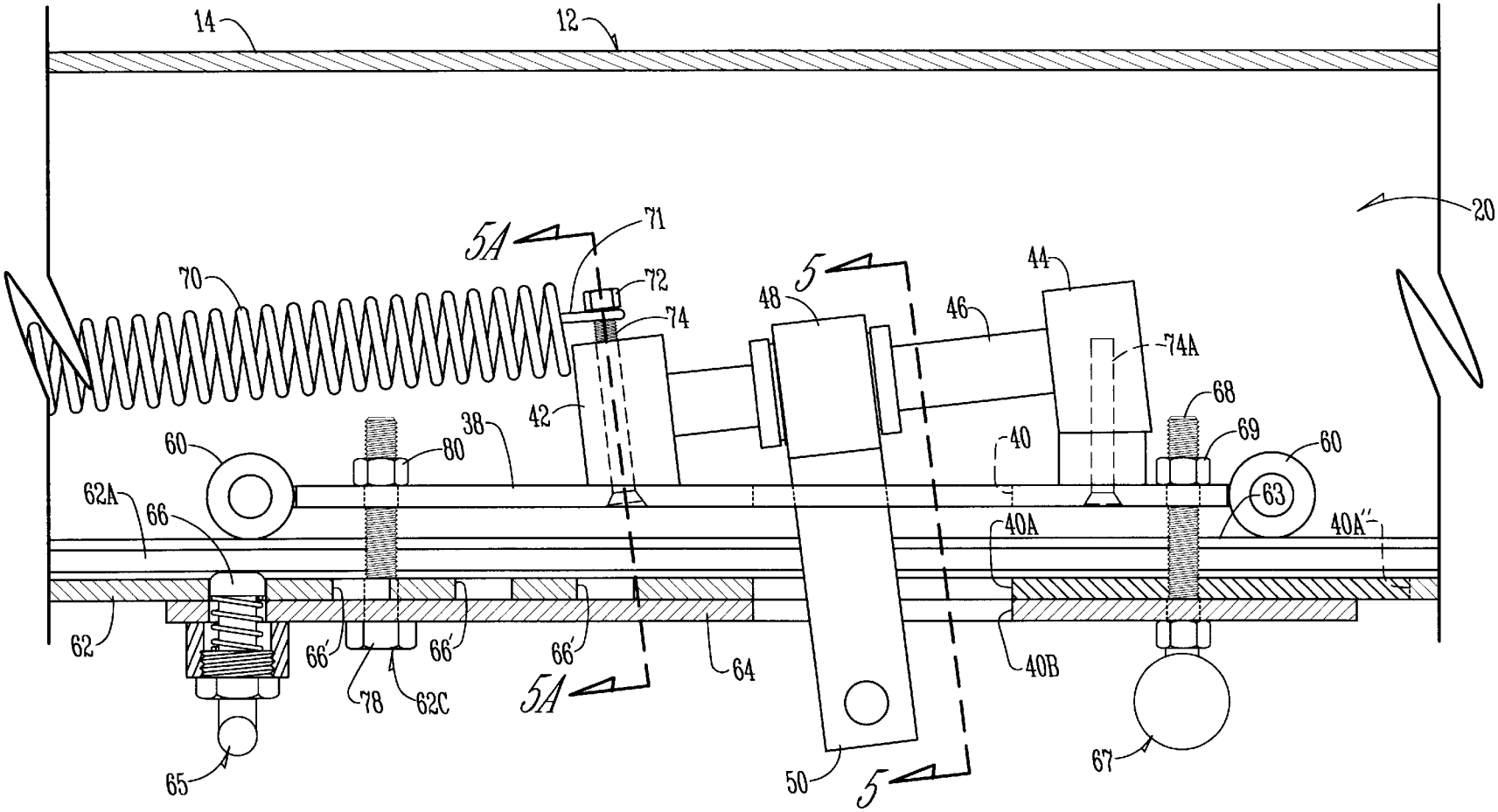
FIG. 3 is an enlarged scale sectional longitudinal view taken of the trolley assembly.
Figure 5:
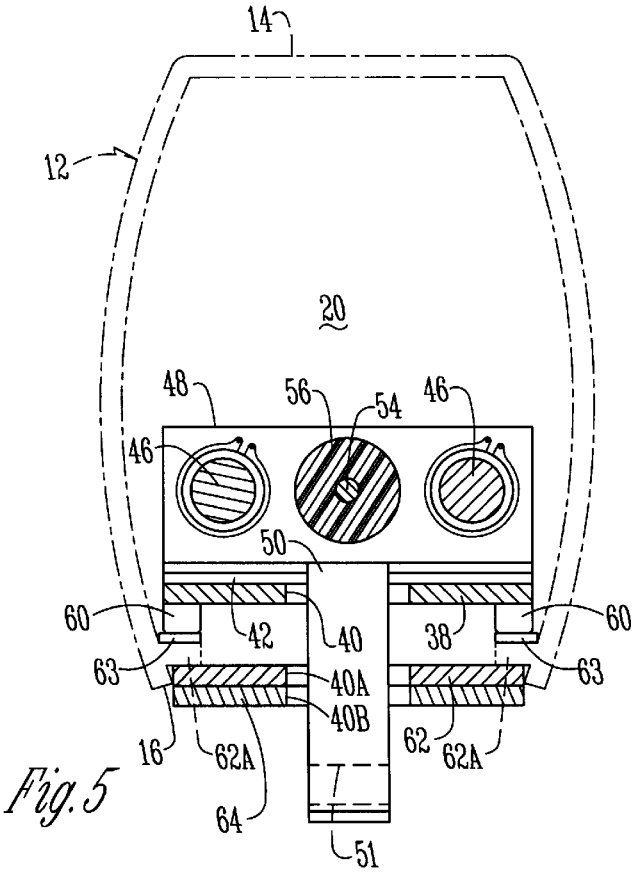
FIG. 5 is a sectional view taken on line 5—5 of FIG. 3.
Figure 5A:
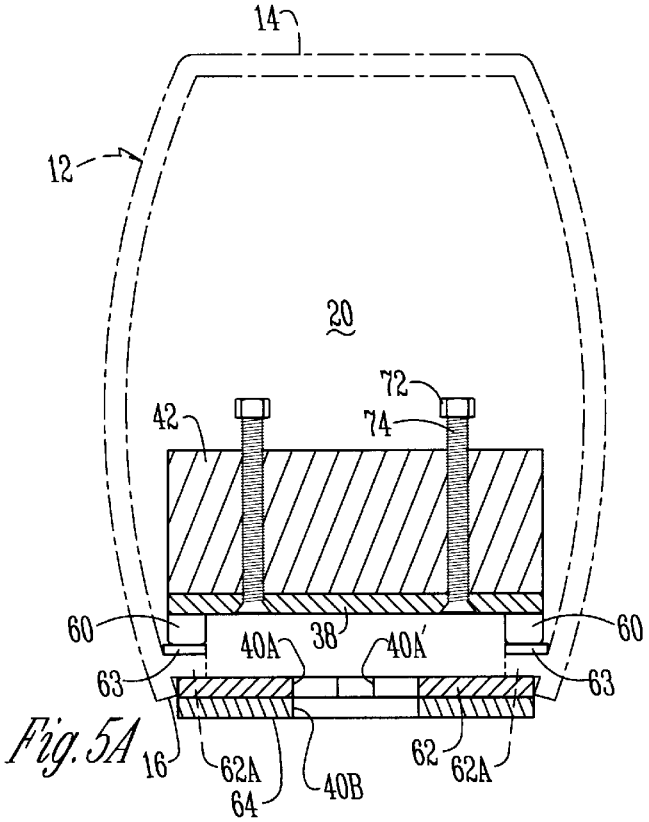
FIG. 5A is a sectional view taken on line 5A—5A of FIG. 3.
Figure 5B:
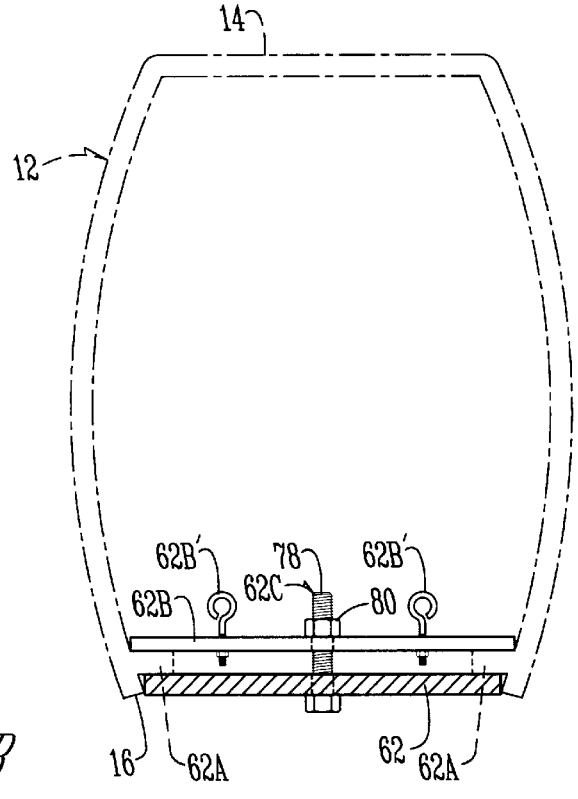
FIG. 5B is a sectional view taken on line 5B—5B of FIG. 1.
Figure 6:
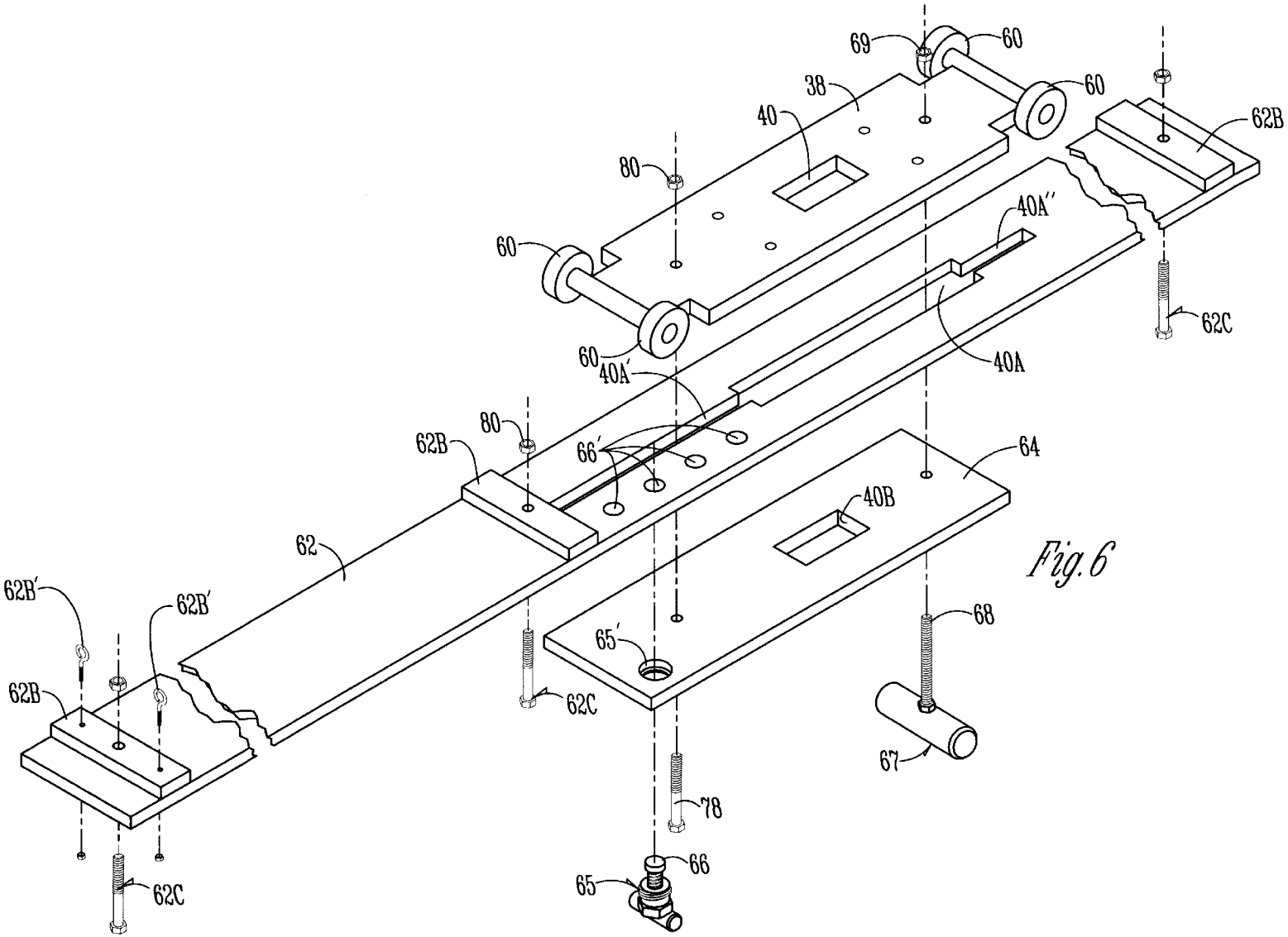
FIG. 6 is an exploded perspective view of the trolley plate and related plates.

A base plate 62 is rigidly supported within the hollow interior of beam member 12 on the interior side of bottom flanges 62A of beam 12 (FIGS. 5B and 6). Three bars 62B extend between the tops of flanges 62A (FIG. 6). Nut and bolt assemblies 62C extend through registering apertures in bars 62B and plate 62 to bind plate 62 against the bottom of flanges 62A (FIG. 5B). Flat bars 63 are mounted on the upper surfaces of flanges 62A above the slots 40A, 40A' and 40A" in plate 62 to serve as bearing surfaces for trolley wheels 60 (FIGS. 3 and 5A). Slots 40A' and 40A" slidably receive arm 50. Plate 62 and plate 64 have registering slots 40A and 40B, respectively, that register with slot 40 in plate 38. (FIG. 6). Arm 50 extends downwardly through registering slots 40, 40A and 40B. Eye bolts 62B' are threadably mounted on the bar 62B adjacent end 18 (FIG. 2).

A conventional snap lock 65 (FIG. 3) is mounted on the lower surface of reinforcing plate 64 and has a spring loaded plunger 66 (FIG. 1) which is adapted to penetrate registering apertures 66' in plate 64 (FIG. 3). A conventional spin lock 67 is also mounted to the lower surface of reinforcing plate 64 and has a threaded bolt 68 which is adapted to be threadably inserted through an aperture in plate 38 for connection with nut 69 (FIG. 3). Both the snap lock 65 and the spin lock 67 are old in the gymnastics art as typically shown in U.S. Pat. No. 3,554,585.

Two parallel tension springs 70 are secured by their inner ends 71 by nuts 72 on bolts 74 mounted in blocks 42. Nuts 72 are welded on the upper ends of bolts 74 to better retain ends 71 of the springs 70 (FIG. 3). The outer ends 76 are secured to eye bolts 62B' mounted on bar 62B (FIG. 2). Bolts 74A secure blocks 44 and 47 to plate 38 (FIG. 3).

Keeper bolt 78 (FIGS. 3 and 6) extends through registering apertures in trolley plate 38 and plate 64 (and through slot 40A' on plate 62. Nut 80 loosely mounted on the upper end of bolt 78 keeps plate 64 from dropping downwardly when the snap lock 65 and spin lock 67 are released.

With the snap lock 65 and the spin lock 67 in their disengaged positions, the springs 70 hold the trolley support assembly 36 in a nearly perfect counter balance or neutral position. In this unlocked state, the beam 12 can be easily raised or lowered by pressure exerted by one hand which will cause the tension in springs 70 to be either increased or decreased as the beam is manually moved to its preferred height. When at the preferred height, the snap lock 65 and the spin lock 67 are moved to their locking positions to maintain the beam 12 at the designated elevation. The spin locks squeeze the trolley assembly 36 against the plate 64. Two springs 70 are preferred because in the event that only one spring was used and it would break, the beam 12 would drop suddenly to its lowest position when the spin lock and snap locks were released.

As the beam is moved to its preferred elevation, the trolley assembly 36 moves back and forth inside the beam on bars 63. As previously described, the trolley assembly 36 is mounted at a small angle with respect to the bottom of the beam 12. This small angle or inclination is important to maximize the reflex action of the mechanism. Tests have shown that when in this position, the reflex mechanism of the device works more smoothly and provides a greater reflex, lift and assist action to the gymnast who is performing, than when the trolley assembly was mounted parallel to the ground or tipped in the opposite direction.

Connecting the clevis 58 to the lower end of arm 50 rather than placing a clevis on the arm to engage a protruding ear on the upper end of leg 22 permits the dimensions of opening 40 to be substantially decreased. This narrower slot 40 leaves much more steel in the plate 38 and leaves more material for the locator holes 66' for snap lock 65 to be drilled into the plate.

Additionally, the supporting mechanism for the legs 22 allows the base members 28 of legs 22 to remain generally below the ends 18 of the beam 12 regardless of the height that the beam is positioned at any given time. This is a very important feature because the safety floor mats under and around the beam which are up to 20 cms, i.e. thick have openings or slots through which the members 28 must pass to engage the floor. If the base members move either out from under or inwardly from the ends of the beam, they would move out of alignment with the slots in the mat systems.

It is therefore seen that this invention will achieve at least all of its stated objectives.

What is claimed is:

1. A balance beam, comprising;

an elongated beam member having opposite ends, a center portion, a top and a bottom, legs on the bottom of said beam member adjacent the ends thereof, each leg having an upper end and a lower end, a support assembly mounted within said elongated beam member adjacent each of the ends thereof and each having a resilient element with a depending arm extending downwardly therefrom with each arm being pivotally secured to one of the upper ends of said legs, said legs extending downwardly and outwardly from said support assembly and terminating in a vertical transverse plane extending through the ends of said beam member so that the lower ends of the legs dwell substantially under the ends of the beam member, and elongated links having opposite ends each pivotally secured by one of their ends to one of the ends of said beam member and to the other one end of each of said legs respectively to hold said beam member in an erected elevated horizontal position.

2. The beam of claim 1 wherein each leg extends downwardly and outwardly from the arm which has a clevis on an upper end thereof pivotally secured to the arm.

3. The beam of claim 1 wherein said beam member is slightly resilient, and said resilient element permitting the upper ends of said legs to move resiliently horizontally towards said center portion when said beam member is loaded and deflected by the weight of a gymnast.

4. The beam of claim 3 wherein said support assembly has two endblocks rigidly secured to said beam member, an intermediate block slidably mounted between said endblocks and associated with said arm, and said resilient element being located between said intermediate block and the endblock nearest the center portion of said beam member so that when a vertical force is applied downwardly on the top of said beam, said resilient element will yieldingly resist the sliding of said intermediate block towards said center portion.

5. The beam of claim 4 wherein said endblocks are rigidly mounted on a base plate which is movably secured to the bottom of said beam member, with said plate having an opening therein through which said arm extends.

6. The beam of claim 3 wherein said support assembly is longitudinally movable with respect to said beam member.

7. The beam of claim 6 wherein a fastening element connects said support assembly and said beam member to selectively rigidly connect said support assembly in one of a plurality of variable positions with respect to said beam member.

8. The beam of claim 6 wherein at least one tensioned spring interconnects said support assembly and said beam member to hold said beam in a neutral height position for upper or lower adjustment by applying upper or lower hand pressure, respectively on said beam.

9. The beam of claim 8 wherein raising or lowering said beam causes said support assembly to move longitudinally.

10. The beam of claim 8 wherein a fastening element connects said support assembly and said beam to selectively rigidly connect said support assembly in one of a plurality of variable positions with respect to said beam.

11. The beam of claim 8 wherein a second tensioned spring is mounted in parallel relation to said first mentioned tensioned spring.

12. The beam of claim 6 wherein said resilient element is mounted on said support assembly in an inclined position.

13. The beam of claim 6 wherein said support assembly has trolley wheels movable within said beam member.

14. The beam of claim 6 wherein said support assembly has trolley wheels movable on bars secured to inwardly extending flanges on the bottom of said beam member.

15. The beam of claim 1 wherein the support assembly includes a plate secured to said beam member, said plate having an elongated slot therein through which said depending arm extends.

16. A balance beam, comprising:

an elongated beam member having opposite ends, a center portion, a top and a bottom, legs on the bottom of said beam member adjacent the ends thereof, each leg having an upper end and a lower end, a trolley assembly mounted within said elongated beam member adjacent the ends thereof, a resilient element movable on an inclined plane mounted on the trolley assembly with a lower end being towards the ends of the beam member and a higher end being towards the center of the beam member.

17. The beam of claim 16 wherein the resilient element permits the upper ends of said legs to move resiliently horizontally towards said center portion when said beam member is loaded and deflected by the weight of a gymnast.

18. The beam of claim 17 wherein said resilient element is mounted the trolley assembly longitudinally movably mounted within said beam member.

19. The beam of claim 18 wherein a fastening element connects said trolley assembly and said beam member to selectively rigidly connect said trolley assembly in one of a plurality of variable positions with respect to said beam.

20. The beam of claim 19 wherein raising or lowering said beam causes said trolley assembly to move longitudinally.

21. The beam of claim 19 wherein at least one tensioned spring interconnects said trolley assembly and said beam member to hold said beam in a neutral height position for upper or lower adjustment by applying upper or lower hand pressure, respectively on said beam.

22. The beam of claim 21 wherein a second tensioned spring is mounted in parallel relation to said first mentioned tensioned spring.

23. The beam of claim 18 wherein said resilient element is mounted on said trolley assembly in an inclined position.

24. The beam of claim 18 wherein a fastening element connects said trolley assembly and said beam member to selectively rigidly connect said trolley assembly in one of a plurality of variable positions with respect to said beam.

25. The beam of claim 16 wherein the support assembly has two endblocks rigidly secured to said beam member, an intermediate block slidably mounted between said endblocks and associated with said beam member, and said resilient element being located between said intermediate block and the endblock nearest the center portion of said beam member so that when a vertical force is applied downwardly on the top of said beam, said resilient element will yieldingly resist the sliding of said intermediate block towards said center portion.

26. The beam of claim 25 wherein said endblocks are rigidly secured to a base plate which is movably secured to the bottom of said beam member, with said plate having an opening therein through which said member extends.

27. The beam of claim 26 wherein said endblocks are rigidly mounted on a base plate which is movably secured to the bottom of said beam member, with said plate having an opening therein through which said arm extends.

28. The beam of claim 16 wherein said trolley assembly has trolley wheels movable within said beam member.

29. The beam of claim 14 wherein said trolley assembly has trolley wheels movable on bars secured to inwardly extending flanges on the bottom of said beam member.

* * * * *

UNITED STATES PATENT AND TRADEMARK OFFICE

CERTIFICATE OF CORRECTION

PATENT NO. : 6,077,195

DATED : June 20, 2000

INVENTOR(S) : Mark R. LANE; Neal C. SQUIBB; Leslie M. ARP; Sue M. SHERLOCK; Martha NICHOLS-KETCHUM; Bill W. SORENSON It is certified that error appears in the above-identified patent and that said Letters Patent are hereby corrected as shown below:

Column 4, line 56, strike "secured to" and substitute - mounted on -.

Column 5, line 7, after "beam" insert the word - member -.

Column 5, line 9, after "beam" insert the word - member -.

Column 5, line 42, strike "the" and insert - on a -.

Column 6, line 5, strike the numeral "19" and insert the numeral - 18 -.

Column 6, line 39, strike the numeral "14" and insert the numeral - 16 -.

Signed and Sealed this

Third Day of April, 2001

*Attest:*

Nicholas P. Godici

NICHOLAS P. GODICI

*Attesting Officer*

*Acting Director of the United States Patent and Trademark Office*